US005383289A

United States Patent [19]

Webb et al.

[11] Patent Number: 5,383,289

[45] Date of Patent: Jan. 24, 1995

[54] TEXTILE DRYING SYSTEM

[75] Inventors: Phillip S. Webb; Andrew R. Messner, both of Galax; John A. Street, Fries, all of; Richard S. Gardner, Mexico City, Mexico

[73] Assignee: Sara Lee Corporation, Winston-Salem, N.C.

[21] Appl. No.: 68,209

[22] Filed: May 28, 1993

[51] Int. Cl.[6] ..... F26B 3/00

[52] U.S. Cl. ..... 34/449; 34/468; 34/447; 34/73; 34/561

[58] Field of Search ..... 34/560, 561, 557, 443, 34/444, 445, 446, 447, 448, 449, 467, 468, 474, 72, 73

[56] References Cited

U.S. PATENT DOCUMENTS

| | | | |
|---|---|---|---|
| 1,545,395 | 7/1925 | Carroll . | |
| 1,567,709 | 12/1925 | Carroll . | |
| 2,499,328 | 2/1950 | Pawlansky . | |
| 2,913,832 | 11/1959 | Kaufman . | |
| 2,942,352 | 6/1960 | Estienne | 34/561 |
| 3,050,920 | 8/1962 | Norton . | |
| 3,604,124 | 9/1971 | Leeds et al. | 34/448 |
| 3,621,585 | 11/1971 | Robertson . | |
| 3,961,425 | 6/1976 | Swanson et al. | 34/447 |
| 4,199,871 | 4/1980 | Ward et al. | 34/447 |
| 4,475,295 | 10/1984 | Hussmann . | |

*Primary Examiner*—Denise L. Gromada

[57] ABSTRACT

A drying system for drying textiles. The textile drying system includes an enclosed dryer having heating elements located therein, a feed system for continuously feeding textiles through the dryer, and a dehumidifier for directing conditioned air into the dryer. The textiles are dried in the dryer due to a combination of the heating elements located in the dryer and the conditioned air directed into the dryer by the dehumidifier. The dehumidifier conditions the ambient air to a selected temperature and relative humidity, and directs this air into the dryer. An exhaust port located in the dryer provides an opening for air within the dryer to exit to the atmosphere. The speed at which textiles are advanced through the dryer by the feed system is controlled by a moisture sensor which senses the moisture content of the textile goods exiting the dryer 12 and controls the speed of the feed system accordingly.

8 Claims, 1 Drawing Sheet

TEXTILE DRYING SYSTEM

BACKGROUND OF THE INVENTION

1. Field of the Invention

The present invention relates generally to a method and apparatus for drying textiles, and more particularly, to a method and apparatus for drying textiles using the addition of dehumidified air.

2. Description of the Prior Art

Many textile manufactures must dry long, knitted sheets of textile fabrics. Due to the large quantity of textiles that must be dried, the amount of time required and the cost of utilities to dry these types of textiles is very substantial. Any increase in the productivity of drying textile sheets or any decrease in the utility cost of drying textile sheets will significantly increase the efficiency of the textile drying process.

Continuous steam heated, textile drying systems are currently used to dry long, knitted sheets of textiles. The continuous textile drying systems of the prior art typically include an enclosed dryer having a plurality of steam heating elements disposed therein and a feed system for continuously feeding textiles through the dryer. Steam is circulated through the heating element in the dryer to heat air within the dryer. The feed system continuously advances the textile sheets through the dryer so that the heated air within the dryer drys the textile sheets passing through the dryer. A particular section of a textile sheet is dried for the period of time in which it remains within the dryer. The period of time that a particular section remains in the dryer and the extent to which the textile sheet is dried, depends on the speed at which the feed system advances the textile sheets.

The feed system is controlled to feed the textile sheets through the dryer at a speed that ensures that the textiles spend sufficient time in the dryer to reach a selected moisture content. If the textile sheets are fed through the dryer at too great a speed, the textile sheets will not be sufficiently dried. Likewise, if the textiles are fed through the dryer at too low of a speed, productivity of the drying system will unnecessarily be reduced. The overall productivity of a continuous textile drying system is controlled by the rate of speed at which the textile sheets can be dried to a selected moisture content as they are advanced by the feed system through the dryer.

The continuous textile drying systems of the prior art must be fed through the dryer at relatively low speeds to ensure sufficient drying of the textile sheets. Because of the relatively low speed at which the textile sheets are advanced, the productivity of an individual dryer is relatively low. Accordingly, businesses must often invest in many individual dryers to handle their textile drying needs. In addition, continuous textile drying systems of the prior art demand a substantial amount of energy to operate the process resulting in relatively high utility expenses. Improvements in the productivity of continuous textile systems and reductions in the utility costs associated with continuous textile drying systems will provide significant cost savings to businesses using continuous textile drying systems.

Thus, there remains a need for a new and improved dryer for textile materials which is operable at increased productivity while, at the same time, requires less utility costs than a conventional dryer.

SUMMARY OF THE INVENTION

The present invention is directed to a textile drying system which provides for significant productivity increases and utility savings over prior art textile drying systems. The present invention includes an enclosed dryer having a plurality of steam heating elements located therein, a dehumidifier connected to the dryer for providing dehumidified air to the dryer, and a feed system for continuously feeding textiles through the dryer. Textile sheets being fed through the dryer by the feed system are dried due to the combination of the heating elements located in the dryer and the circulation of dehumidified air into the dryer. The heating elements heats air within the dryer provide heated air to dry the textiles. The dehumidifier dehumidifies atmospheric air and directs this air into the dryer. The dehumidified air from the dehumidifier increases the ability of air within the dryer to draw moisture from the textile sheets. The moisture laden air is exhausted from the dryer into the atmosphere.

The combination of the heating elements and the dehumidified air more effectively dries the textile sheets than heating elements alone. The productivity of the textile drying system is improved because the feed system can be operated at a higher speed while still effectively drying the textile sheets passing through the dryer. In addition, the utility costs associated with the drying of a quantity of textile sheets are reduced when compared to prior art drying systems.

Accordingly, one aspect of the present invention is to provide a textile drying system for drying textiles. The apparatus includes: (a) an enclosed dryer having a textile input and a textile output, the dryer including an interior space, an inlet leading into the interior space, and an outlet leading from the dryer interior space; (b) a heating element located within the dryer for heating air in the interior space of the dryer so as to dry textiles being fed through the dryer; and (c) at least one dehumidifier connected to the dryer and having an inlet and an outlet, the dehumidifier inlet substantially open to the atmosphere and the dehumidifier outlet connected to the inlet of the dryer, the dehumidifier drawing ambient air through the dehumidifier inlet and into the dehumidifier interior where the ambient air is conditioned to a selected temperature and dehumidified to a selected relative humidity, the dehumidifier directing the conditioned air through the dehumidifier outlet and into the interior space of the so as to dry textiles being passed through the dryer, and wherein the exhaust outlet exhausts saturated air from the dryer.

Another aspect of the present invention is to provide a method for drying textiles. The method includes the steps of: (a) loading textiles into an enclosed dryer; (b) drawing atmospheric air into a dehumidifier to condition the atmospheric air by dehumidifying and heating the atmospheric air; (c) directing the conditioned air from the dehumidifier into the dryer so as to dry textiles in the dryer; (d) heating heating elements positioned within the dryer to heat air located within the dryer so that the air within the dryer is heated so as to dry textiles in the dryer; and (e) exhausting the saturated air from the dryer.

These and other aspects of the present invention will become apparent to those skilled in the art after a reading of the following description of the preferred embodiment when considered with the drawings.

DESCRIPTION OF THE PREFERRED EMBODIMENTS

Figure 1:
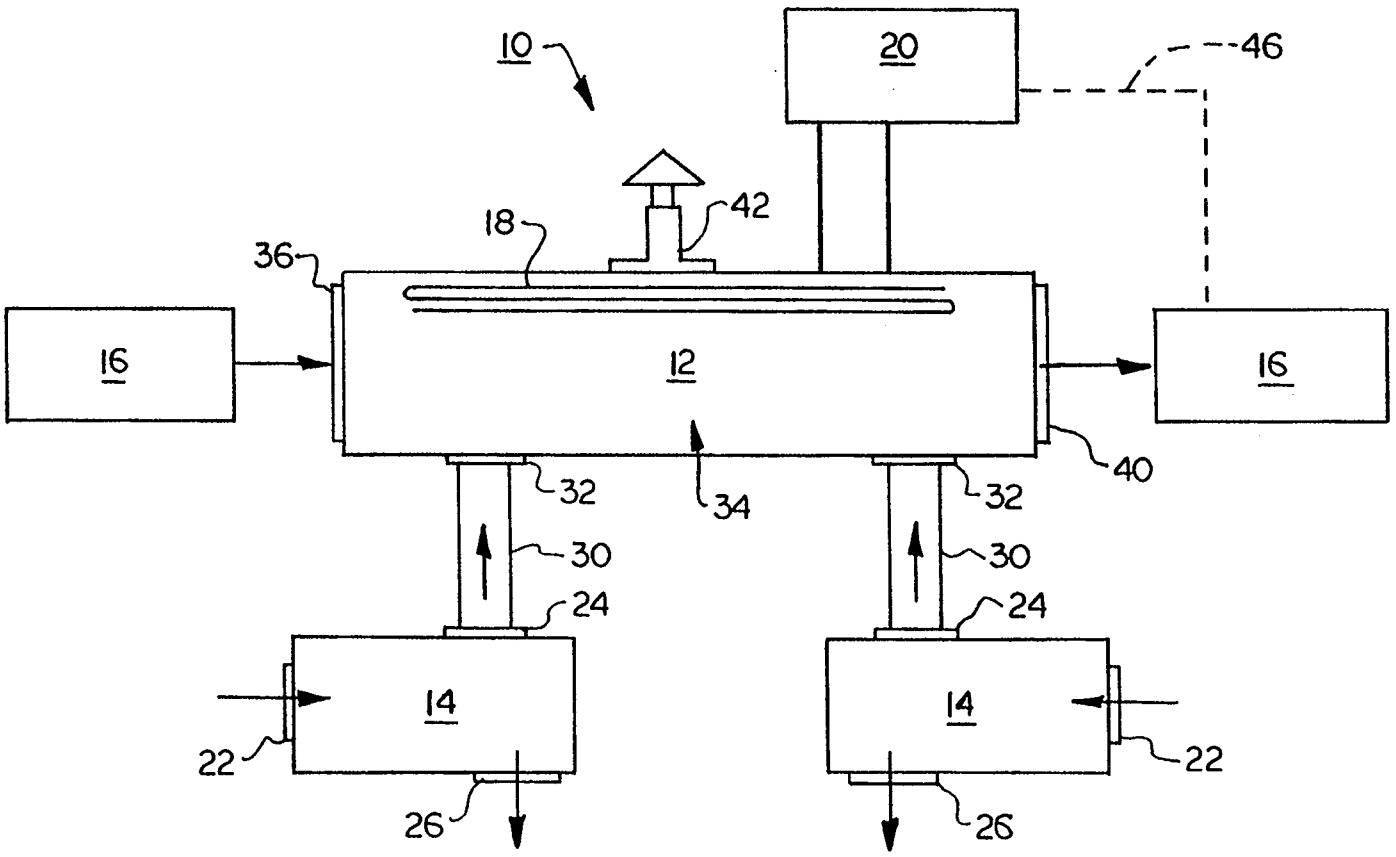
FIG. 1 is a schematic view of a preferred embodiment of a textile drying system constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to FIG. 1, it will be understood that the illustrations are for the purpose of describing a preferred embodiment of the invention and are not intended to limit the invention thereto. As best seen in FIG. 1, the textile drying system of the present invention is generally designated 10. In the preferred embodiment, textile drying system 10 is designed to continuously feed tubular, knitted sheets of textile material through an enclosed dryer for removing moisture from the fabric. The major components of textile drying system 10 include an enclosed dryer 12, a pair of dehumidifiers 14, a textile feed system 16, and a moisture sensor 20.

Dryer 12 is used to dry textile sheets which are continuously fed through dryer 12 by feed system 16. Textile sheets passing through dryer 12 are dried due to the combination of steam heating elements 18 located within an interior space 34 of dryer 12 and the dry air supplied by a pair of dehumidifiers 14. Heating elements 18 include a series of heating coils through which steam is circulated so as to heat the air in interior space 34 of dryer 12.

Dryer 12 is connected to dehumidifiers 14 which direct conditioned air into dryer 12 to aid heating elements 18 in the drying of the textile sheets. In the preferred embodiment, dehumidifiers 14 are continuously regenerated honeycomb-type dehumidifiers such as a model HC-4500, manufactured by Cargocaire Engineering Corporation of Amesbury, Mass. Dehumidifiers 14 each include a dehumidifier inlet 22, a dehumidifier outlet 24, and a dehumidifier exhaust port 26. Dehumidifier inlets 22 are open to the atmosphere and ambient air is drawn through inlets 22 and into the dehumidifiers 14 where the ambient air is conditioned. The ambient air drawn into the dehumidifiers 14 is conditioned by removing moisture from the air and also heating the air from residual heat left over as the dehumidifier is continuously regenerated. Exhaust heat and water vapor produced by dehumidifiers 14 are exhausted from exhaust ports 26. The conditioned air from dehumidifiers 14 is directed through outlets 24 which are connected to inlets 32 of dryer 12 by conduits 30.

Conditioned air from dehumidifiers 14 is directed through inlets 32 and into the interior space 34 of dryer 12. Directing conditioned air from dehumidifiers 14 into dryer 12, in addition to the heating of air in dryer 12 with heating coils 18, more effectively dries textile sheets being continuously fed through dryer 12 by textile feed system 16.

Textile feed system 16 continuously advances textile sheets through an input 36 of dryer 12, through interior space 34, and out of output 40 of dryer 12. As the textile sheets travel through interior space 34 of dryer 12, air within dryer 12 draws moisture from the textile sheets and becomes saturated as the textile sheets are dried. An exhaust port 42 is positioned at the top of dryer 12 and provides an opening for humidified air to escape from dryer 12. Exhaust port 42 of dryer 12 is opened to the atmosphere and humidified air from dryer 12 is exhausted directly into the ambient air.

Feed system 16 is controlled to advance the textile sheets at a speed that ensures that the textile sheets spend sufficient time within the dryer 12 to satisfactorily dry the textile sheets. Moisture sensor 20 is connected to the feed system 16 to control the rate of speed at which the feed system 16 advances textile sheets. Moisture sensor 20 is connected to the outlet of dryer 12 and senses the moisture content of the textile goods leaving dryer 12. Based on the measured moisture of the textile goods leaving the dryer 12, moisture sensor 20 signals feed system 16 via electrical coupler 46 to adjust the speed of dryer 12 accordingly. A moisture content sensed by moisture sensor 20 which is above a selected reference point will result in moisture sensor 20 signaling feed system 16 to slow the advance of the textile sheet. Slowing the advancement of the textile sheets results in the textile sheets spending a longer period of time within the dryer 12 so as to provide additional drying of the textile sheets. Likewise, if the moisture sensor 20 senses a moisture content that is below a reference point, the moisture sensor 20 signals feed system 16 to increase the rate of advancement of the textile sheet through dryer 12. Increasing the speed of the textile sheets prevents the textile sheets from spending an unnecessary amount of time within dryer 12.

In operation, textile sheets are advanced through dryer 12 by feed system 16. Before entering dryer 12, the textile sheets typically have a moisture content of 1 pound of water per pound of goods and a temperature of between about 70° and 80° F. Dehumidifiers 14 and heating elements 18 cooperate to dry the textile goods to a moisture content of 4½–5% after having passed completely through dryer 12. Dehumidifiers 14 aid in the drying of the textile sheets by drawing ambient air into dehumidifiers 14 through inlets 22. The ambient air drawn into dehumidifiers 14 is dehumidified and heated to produce a conditioned air having a relative humidity between 11–14% and a temperature between 100°–115° F. During conditioning of the atmospheric air, dehumidifiers 14 removes excess moisture from the honeycomb wheel which is exhausted through exhaust ports 26. Conditioned air is directed out of the dehumidifier outlets 24 and into conduits 30. Conduits 30 are connected to inlets 32 of dryer 12 and direct the conditioned air into the interior space 34 of dryer 12 to dry the textile sheets passing through dryer 12.

Heating elements 18 also function to aid, in combination with the conditioned air from dehumidifiers 14, the drying of the textile sheets passing through dryer 12. Steam is circulated through heating elements 18 to provide a heat source within dryer 12 to heat the air located therein. The heating of the air within dryer 12 results in the textile sheets being dried as they pass through dryer 12. During the drying process, moisture is drawn from the textile sheets and passed into the air, resulting in the air within dryer 12 becoming saturated. Dryer outlet 24 opens to the atmosphere to allow saturated air from dryer 12 to be exhausted.

During the drying process, moisture sensor 20 senses the moisture content of the goods exiting from dryer 12. Moisture sensor 20 signals feed system 16 to adjust the speed at which feed system 16 advances the textile sheets through dryer 12 is adjusted based on readings of the moisture content of the goods exiting the dryer 12. Textile sheets are advanced out of dryer 12 after being dried to a moisture content of roughly between 4½–5%.

The use of dehumidifiers 14 in combination with heating elements 18 with dryer 12 and feed system 16 results in textile fabric system 10 achieving a higher productivity and reduced utility costs compared to continuous textile fabric systems of the prior art. For example, according to a test between continuous textile drying system 10 of the present invention and a continuous textile drying system of the prior art, continuous textile drying system 10 was more productive and used less utilities in the drying process.

The process and apparatus according to the present invention will become more apparent upon reviewing the following detailed examples.

EXAMPLE NO. 1

Tubular cotton sheets were dried in a conventional continuous steam heated ALEA drier. The textile sheets had an initial moisture content of 1 pound of water per pound of fabric and a temperature of between about 70° to 80° F., and were dried to a moisture content of 4½–5%. The maximum achievable rate of production was 1,394.5 lbs. of cloth per hour.

The dryer required 2.40 lbs. of steam to dry one pound of cloth. The calculated total drying cost per pound of cloth was $0.0149.

EXAMPLE NO. 2

Tubular cotton sheets were dried in a conventional continuous steam heated ALEA drier modified according to the present invention to include two high output dehumidifiers each supplying 4500 CFM of 11–14% relative humidity air at between about 100° to 115° F. to the dryer. 9000 CFM of saturated air was exhausted from the dryer through the roof. The textile sheets had an initial moisture content of 1 pound of water per pound of fabric and a temperature of between about 70° to 80° F., and were dried to a moisture content of 4½–5%. The maximum achievable rate of production was 1,809.4 lbs. of cloth per hour. The dryer required 1.93 lbs. of steam to dry one pound of cloth. The dehumidifiers used 182.77 KW at a cost of $0.035 per KW. The calculated total drying cost per pound of cloth was $0.0121.

As can be seen from the above examples, the textile drying system constructed according to the present invention was able to dry the knitted textile sheets at a production rate of almost 30% greater than the dryer without the dehumidifiers.

In addition, surprisingly the test results also showed that textile drying system 10 of the present invention reduced total utility costs, including steam and electric costs, about 20% when compared to the textile drying system of the prior art. This is unexpected since it was believed that the energy savings in steam would be offset by the energy costs of the dehumidifiers. However, it is believed that the efficiency improvement can be attributed because the dehumidifiers used only ambient and not recycled air and that the heat added to the dehumidified air by the dehumidifiers also aided the drying process. Also, while any amount of low humidity air added improves the drying process, no upper limit to the amount of low humidity air added has been found.

Certain modifications and improvements will occur to those skilled in the art upon a reading of the foregoing description. By way of example, a humidity sensor could be added at the exhaust port 42 of dryer 12 and used to control the amount of dehumidified air being introduced into the dryer to further improve the efficiency of the present invention. It should be understood that all such modifications and improvements have been deleted herein for the sake of conciseness and readability but are properly within the scope of the following claims.

We claim:

1. A textile drying system for drying textiles comprising:

(a) an enclosed dryer having a textile input and a textile output, the dryer including an interior space, an inlet leading into the interior space, and an outlet leading from the dryer interior space;

(b) a heating element located within the dryer for heating air in the interior space of the dryer so as to dry textiles being fed through the dryer; and (c) at least one dehumidifier connected to the dryer and having an inlet and an outlet, the dehumidifier inlet substantially open to the atmosphere and the dehumidifier outlet connected to the inlet of the dryer, the dehumidifier drawing ambient air through the dehumidifier inlet and into the dehumidifier interior where the ambient air is conditioned to a selected temperature and dehumidified to a selected relative humidity, the dehumidifier directing the conditioned air through the dehumidifier outlet and into the interior space of the so as to dry textiles being passed through the dryer, and wherein the exhaust outlet exhausts saturated air from the dryer into the atmosphere.

2. The textile drying system according to claim 1 wherein the selected relative humidity of the conditioned air is substantially within the range of between 11–14%.

3. The textile drying system according to claim 2 wherein the selected temperature of the conditioned air is substantially within the range of between 100°–115° F.

4. The textile drying system according to claim 1, further including a textile feed system for continuously feeding textiles into the input of the dryer, through the interior space of the dryer, and through the output of the dryer.

5. The textile drying system according to claim 1 further including a moisture sensor connected with the interior of the dryer, the moisture sensor also coupled to the textile feed system and controlling the speed of the textile feed system based on the relative humidity within the dryer.

6. A method for drying textiles comprising:

(a) loading textiles into an enclosed dryer;

(b) drawing atmospheric air into a dehumidifier to condition the atmospheric air by dehumidifying and heating the atmospheric air;

(c) directing the conditioned air from the dehumidifier into the dryer so as to dry textiles in the dryer;

(d) heating heating elements positioned within the dryer to heat air located within the dryer so that the air within the dryer is heated so as to dry textiles in the dryer; and (e) exhausting substantially all the saturated air from the dryer directly into the atmosphere.

7. The method according to claim 6 wherein the dehumidifier conditions the atmospheric air to a relative humidity substantially within the range of between 11–14%.

8. The method according to claim 7 wherein the dehumidifier conditions the atmospheric air to a temperature substantially within the range of between 100°–115° F.

* * * * *